US008774438B2

(12) United States Patent
Akino

(10) Patent No.: US 8,774,438 B2
(45) Date of Patent: Jul. 8, 2014

(54) MICROPHONE UNIT AND HIGHLY DIRECTIONAL MICROPHONE

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 429 days.

(21) Appl. No.: 13/204,761

(22) Filed: Aug. 8, 2011

(65) Prior Publication Data

US 2012/0033844 A1 Feb. 9, 2012

(30) Foreign Application Priority Data

Aug. 9, 2010 (JP) ..... 2010-178639

(51) Int. Cl.
*H04R 9/08* (2006.01)
*H04R 25/00* (2006.01)

(52) U.S. Cl.
USPC ..... 381/356; 381/174

(58) Field of Classification Search
CPC ..... H04R 1/02; H04R 1/32; H04R 19/016
USPC ..... 381/356, 174
See application file for complete search history.

(56) References Cited

FOREIGN PATENT DOCUMENTS

| | | |
|---|---|---|
| JP | 56-52386 U | 9/1979 |
| JP | 62-11898 | 5/1987 |
| JP | 04-246999 | 9/1992 |

*Primary Examiner* — Curtis Kuntz
*Assistant Examiner* — Sunita Joshi
(74) *Attorney, Agent, or Firm* — Whitham Curtis Christofferson & Cook, PC

(57) ABSTRACT

A microphone unit has a diaphragm vibrating in response to sound waves; a unit casing accommodating the diaphragm; and a connecting path connecting a front acoustic terminal and a rear acoustic terminal. The unit casing has a small-diameter internal periphery defining the front acoustic terminal; a large-diameter internal periphery accommodating built-in components including the diaphragm; and a shoulder provided between the small-diameter internal periphery and the large-diameter internal periphery and positioning the built-in components. The unit casing has a groove in an axial direction provided in the large-diameter internal periphery and a groove in a radial direction provided in the shoulder and being in communication with the groove in the axial direction. The groove in the axial direction and the groove in the radial direction configure the connecting path.

7 Claims, 6 Drawing Sheets

PRIOR ART

MICROPHONE UNIT AND HIGHLY DIRECTIONAL MICROPHONE

BACKGROUND OF THE INVENTION

1. Field of the Invention

The present invention relates to a microphone unit suitable for a highly directional microphone, the microphone unit allowing—vibration noise and wind noise to be reduced and exhibiting enhanced acoustic performance. The present invention also relates to a highly directional microphone including the microphone unit.

2. Related Background Art

A highly directional microphone includes a microphone unit incorporated into a long and thin acoustic tube. Wind blowing at the open end of the acoustic tube causes a pressure difference between the front and rear of a diaphragm included in the microphone unit. Such a difference causes wind noise. The highly directional microphone has a long distance between a front acoustic terminal, which is provided in the front end of the acoustic tube as a sound wave inlet, and a rear acoustic terminal, which is provided in the rear end of the acoustic tube. Accordingly, a pressure difference can be readily generated between the front acoustic terminal and the rear acoustic terminal. With the diaphragm of the microphone unit provided between the front acoustic terminal and the rear acoustic terminal, the pressures difference is generated between the front and rear of the diaphragm, thus resulting in large wind noise in a low frequency range in particular.

The air inside the acoustic tube acts as an acoustic mass in the low frequency range. Application of the acoustic mass to the diaphragm increases vibration noise in the low frequency range. The wind noise and the vibration noise mainly include low frequency components. In order to reduce noise output, a low-cut filter may be used in an electronic circuit of a highly directional microphone. Since a displacement of the diaphragm due to wind or vibration, however, modulates audio signals, use of the low-cut filter results in an insufficient noise reduction effect.

To address the circumstances, a highly directional microphone is proposed which includes a microphone unit provided with a gap from an internal peripheral surface of an acoustic tube so as to form a connecting path between a front acoustic terminal and a rear acoustic terminal, as is disclosed in, for example, Japanese Unexamined Patent Application Publication No. S62-118698. Such a highly directional microphone can reduce wind noise regardless of a pressure difference generated between a front acoustic terminal and a rear acoustic terminal, since air on a high pressure side flows into a low pressure side through such a connecting path to balance the pressure difference.

In the microphone disclosed in Japanese Unexamined Patent Application Publication No. S62-118698, however, a microphone unit is positioned with a gap from an internal peripheral surface of an acoustic tube. This configuration causes an inevitable increase in the size of the acoustic tube and thus an increase in the size of the entire device. In the case of a small highly directional microphone including an acoustic tube with an external diameter of 8 mm, for instance, the ratio of the external diameter of a microphone unit to the internal diameter of an acoustic tube is significantly small. In the case of a condenser microphone unit, the effective capacitance is reduced in proportion to a reduction in size. Thus, the sensitivity and S/N ratio are low with such a highly directional microphone having the acoustic tube having a small external diameter.

Japanese Unexamined Patent Application Publication No. H4-246999 discloses a highly directional microphone, as shown in FIG. 6, in which a connecting path C' connecting a front acoustic terminal 2 and a rear acoustic terminal 3 is provided in a unit casing 4 of a microphone unit 40. In the highly directional microphone shown in FIG. 6, even if a pressure difference is generated between the front acoustic terminal 2 and the rear acoustic terminal 3, air on a high pressure side flows into a low pressure side and thus the pressure difference is balanced.

Thus, the highly directional microphone shown in FIG. 6 can reduce wind noise generated by the pressure difference. Furthermore, the connecting path C' provided in the interior of the unit casing 4 can eliminate necessity of a gap to be formed between the internal peripheral surface of the acoustic tube and the external peripheral surface of the microphone unit. Accordingly, the diameter of the acoustic tube can be reduced compared to the case of the highly directional microphone disclosed in Japanese Unexamined Patent Application Publication No. S62-118698.

If provided with an acoustic tube having an entire length of 100 mm or more, for example, in order to ensure high directivity in a low frequency range, however, the highly directional microphone shown in FIG. 6 does not have a sufficient noise reduction effect unless the acoustic impedance of the connecting path C' having a width B' is lowered in the unit casing 4. A large width B' of the connecting path C' increases the eccentricity of built-in components 5 other than the unit casing 4 in the microphone unit 40 relative to the internal diameter of the unit casing 4. The axis A of the microphone unit 1 may then be moved to a position A', for example, thus adversely affecting the acoustic performance of the microphone unit 40.

In addition, a metal mesh 50 is disposed between the unit casing 4 and a diaphragm holder 14 to ensure the connecting path C' to the front acoustic terminal 2 in the case of the highly directional microphone shown in FIG. 6. The metal mesh 50 itself has an air gap, which causes a gap between the unit casing 4 and the diaphragm holder 14. The connecting path C' is thus open in the anteroposterior direction of the microphone unit. In a portion composed of the metal mesh 50 in the connecting path C', however, the metal mesh 50 is compressed and thinned by the unit casing 4 and the diaphragm holder 14. The metal mesh 50 thus serves as acoustic resistance, causing an adverse effect on the acoustic performance in some cases.

SUMMARY OF THE INVENTION

With respect to a highly directional microphone having a high directivity even in low frequencies, an object of the prevent invention is to provide a microphone unit having reduced acoustic impedance of a connecting path connecting a front acoustic terminal and a rear acoustic terminal to achieve a sufficient wind noise reduction effect and preventing the mutual eccentricity of built-in components of the microphone unit to improve acoustic properties, and a highly directional microphone including the microphone unit.

The present invention provides a microphone unit having a diaphragm vibrating in response to sound waves; a unit casing accommodating the diaphragm; a front acoustic terminal connected to the front of the diaphragm; a rear acoustic terminal connected to the rear of the diaphragm; and at least one connecting path connecting the front acoustic terminal and the rear acoustic terminal, the microphone unit converting vibration of the diaphragm into audio signals. The unit casing has a small-diameter internal periphery defining the front acoustic terminal; a large-diameter internal periphery accommodating built-in components including the diaphragm; and a shoulder provided between the small-diameter internal periphery and the large-diameter internal periphery and positioning the built-in components. The unit casing has a groove in an axial direction provided in the large-diameter internal periphery and a groove in a radial direction provided in the shoulder and being in communication with the groove in the axial direction. The groove in the axial direction and the groove in the radial direction configure the connecting path.

In the microphone unit and the highly directional microphone according to the present invention, the unit casing has the shoulder positioning the built-in components and the groove in the radial direction provided in the shoulder and in communication with the groove in the axial direction. The groove in the axial direction and the groove in the radial direction configure the connecting path between the front acoustic terminal and the rear acoustic terminal. Thus, enlarging the connecting path to reduce the acoustic impedance has no adverse impact on acoustic properties. Even a highly directional microphone having a high directivity in low frequencies can achieve a sufficient noise reduction effect.

DESCRIPTION OF THE PREFERRED EMBODIMENTS

Figure 6:
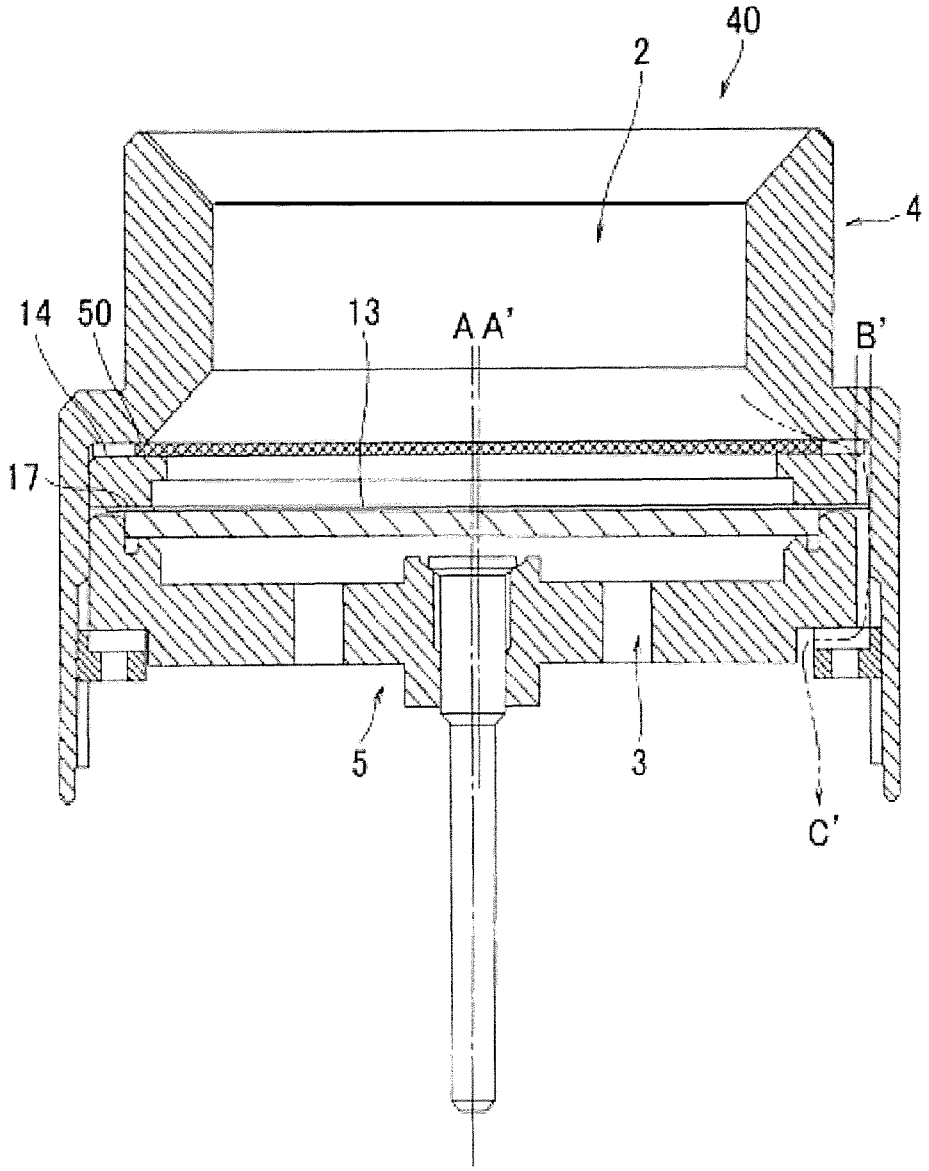
FIG. 6 is a vertical cross-sectional view of a typical conventional highly directional microphone.

The embodiments of a microphone unit and a highly directional microphone according to the present invention are explained below with reference to the attached drawings. The configurations of the microphone unit and the highly directional microphone according to the present invention are not limited to the embodiments. The entirety or a portion of the components built in a unit casing may be referred to as "built-in components." Components similar to those in a conventional example shown in FIG. 6 are assigned with identical reference numerals.

Figure 1:
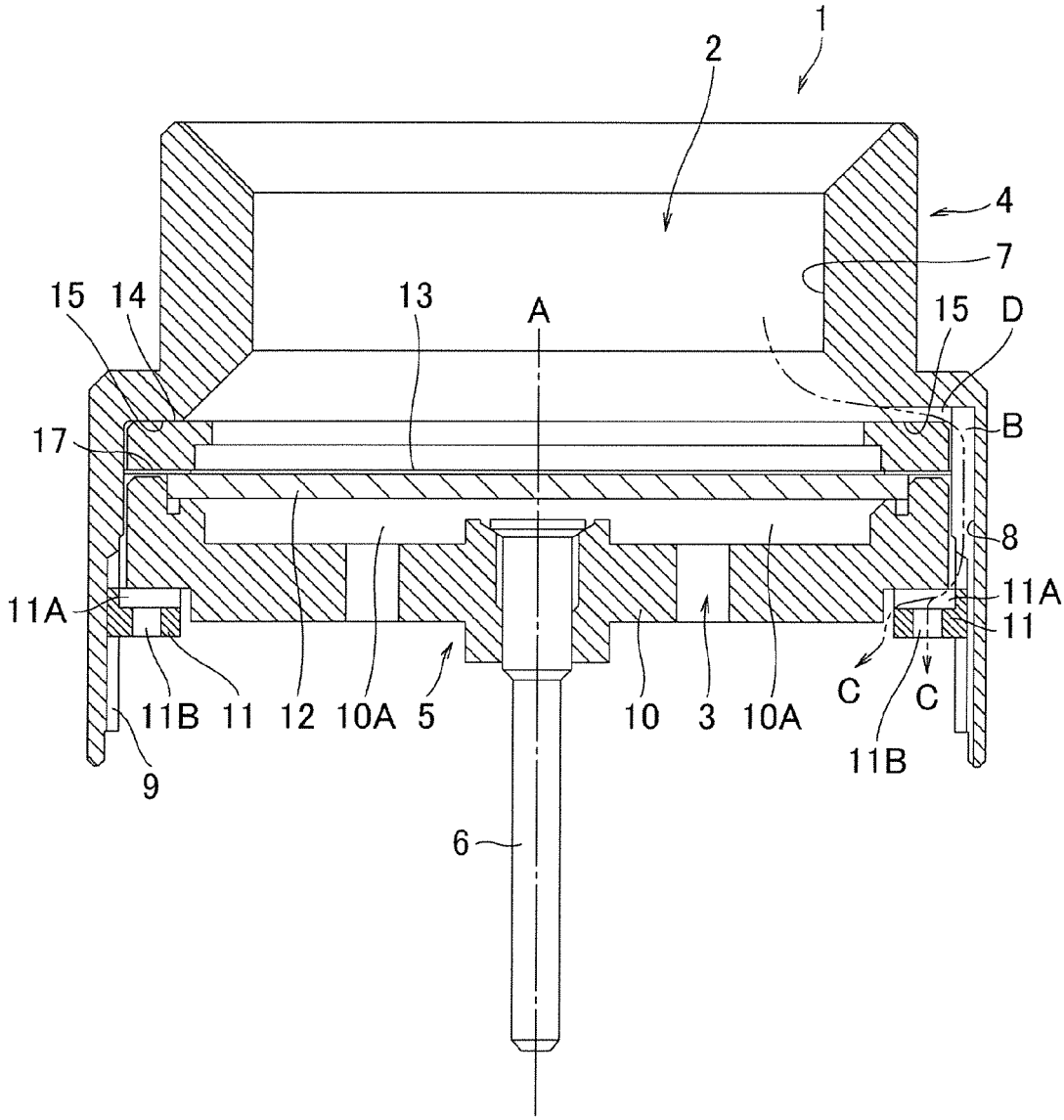
FIG. 1 is a vertical cross-sectional view of a microphone unit according to an embodiment of the present invention.

In FIG. 1, a microphone unit 1 has a diaphragm 13 composed of a disk thin film and vibrating in response to sound waves; a ring diaphragm holder 14 to which the periphery of the diaphragm 13 is fixed; a ring spacer 17; a disk fixed electrode 12 forming a capacitor and disposed oppositely to the diaphragm 13 with a space therebetween provided by the spacer 17; an electrode 6; an insulating washer 10 composed of an insulating material provided adjacent to a back surface (lower side in FIG. 1) of the fixed electrode 12; a front acoustic terminal 2; a rear acoustic terminal 3; a connecting path C connecting the front acoustic terminal 2 and the rear acoustic terminal 3; and the cylindrical unit casing 4 including the built-in components above. The diaphragm 13 vibrates in response to sound waves. In accordance with the vibration, the diaphragm 13 changes the capacity of the capacitor defined thereby with the fixed electrode 12 and converts the sound waves into audio signals.

Figure 2:
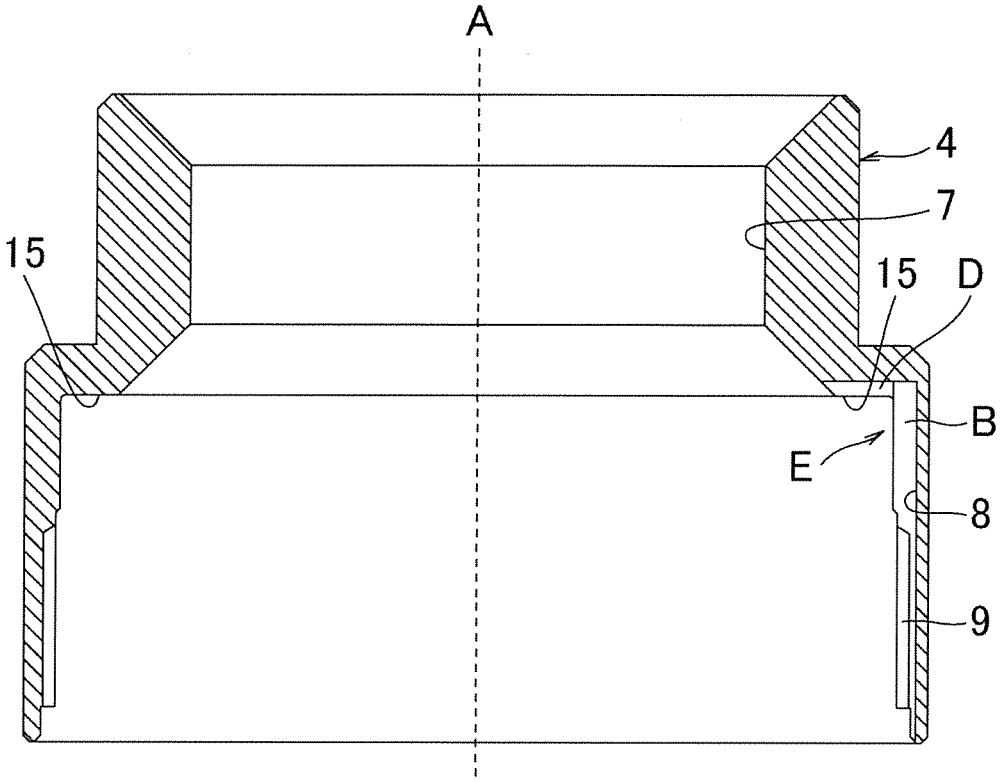
FIG. 2 is a vertical cross-sectional view of a unit casing in the embodiment.

The unit casing 4 has the front acoustic terminal 2, which is an inlet of sound waves, in the front end (upper side in FIGS. 1 and 2). In the unit casing 4, a small-diameter internal periphery 7 on the upper side in FIGS. 1 and 2 configures the front acoustic terminal 2. The unit casing 4 also has a large-diameter internal periphery 8 provided on the lower side in FIGS. 1 and 2 and accommodating built-in components 5 therein; and a shoulder 15 provided between the small-diameter internal periphery 7 and the large-diameter internal periphery 8 and positioning the built-in components 5. The built-in components 5 herein refer to all components accommodated in the unit casing 4.

In FIG. 1, the built-in components 5 are interposed and fixed between a lock ring 11 and the shoulder 15, the lock ring 11 being provided on the internal peripheral surface of the lower portion of the unit casing 4, and being screwed into a female thread 9, and are thus positioned therebetween. Furthermore, the unit casing 4 has a groove B provided in the large-diameter internal periphery 8 in an axial direction A and a groove D provided in the shoulder 15 in a radial direction and in communication with the groove B. The groove B in the axial direction A and the groove D in the radial direction configure the connecting path C connecting the front acoustic terminal 2 and the rear acoustic terminal 3.

The unit casing 4 may have any external shape. As shown in the embodiment in FIGS. 1 and 2, the external periphery of the unit casing 4 may be composed of a large-diameter segment corresponding to the large-diameter internal periphery 8 and a small-diameter segment corresponding to the small-diameter internal periphery 7. The external periphery may have a cylindrical shape having a constant diameter over the entire length, on an internal periphery of which the large-diameter internal periphery 8, the small-diameter internal periphery 7, and the shoulder 15 may be provided.

Figure 3:
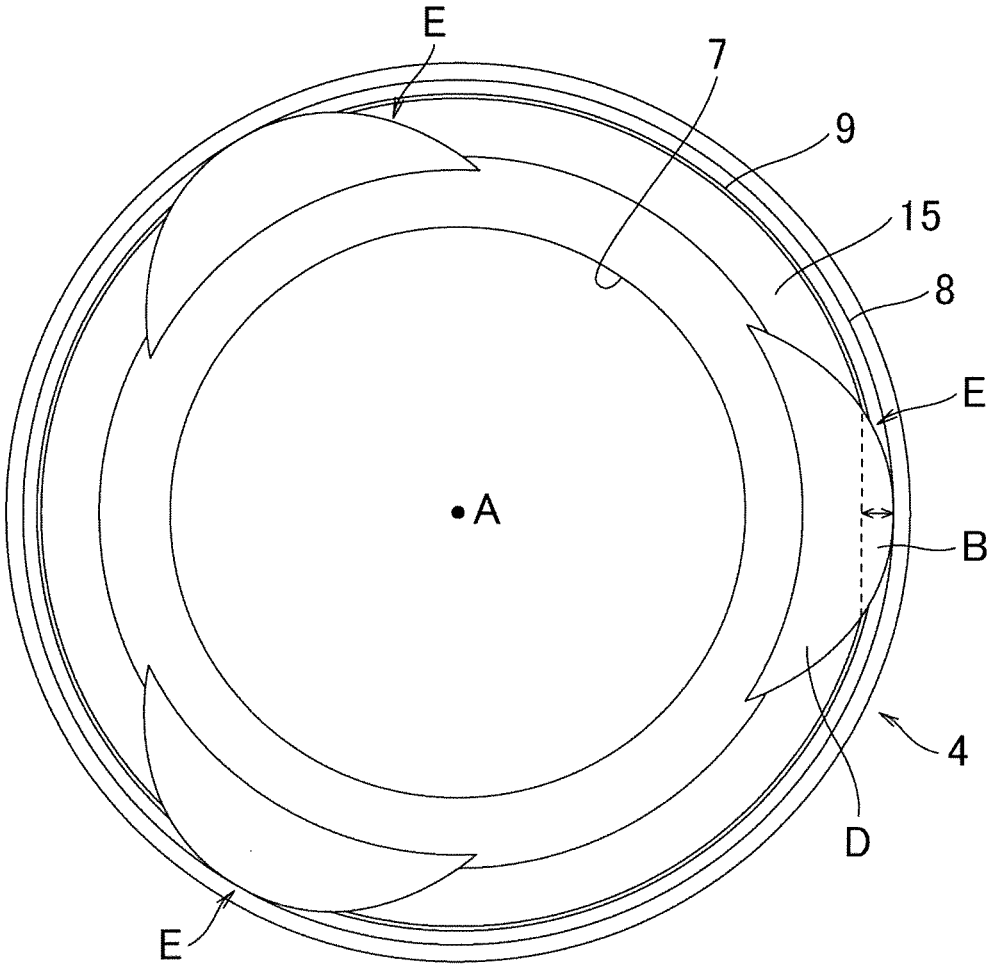
FIG. 3 is a bottom view of the unit casing.

In FIGS. 2 and 3, the unit casing 4 is end-milled from the interior, so that the groove B is provided in the large-diameter internal periphery 8 and the groove D is provided in the radial direction. The groove B and the groove D are combined to define a recess E. In the embodiment, a portion of the large-diameter internal periphery 8 is trimmed by end-milling therealong and a portion of the shoulder 15 is also trimmed by end-milling, so that the recess E is provided. Thus, the recess E has an arcuate or crescent shape viewed from the axial direction A. The recess E thus connects the groove D and the groove B, which then provide the connecting path C. End-milling easily provides the recess E of the unit casing 4. Furthermore, machining as above eliminates a metal mesh 50 conventionally used as shown in FIG. 6, thus preventing adverse impact on acoustic properties associated with the metal mesh 50 and reducing the number of components to reduce the cost.

The recess E can have any shape. In the illustrated embodiment, three connecting paths C each defined by the recess E are provided at equal distances in the circumferential direction of the unit casing 4. At least one connecting path C may be provided. In the case where a plurality of connecting paths C is provided, distances therebetween in the circumferential direction may be equal or unequal. The recess E may be processed in any other appropriate manner.

Thus, the groove B in the axial direction A and the groove D in the radial direction configure the connecting path C between the front acoustic terminal final 2 and the rear acoustic terminal 3. Even if the cross-section of the connecting path C is increased to reduce the acoustic impedance of the connecting path C, the built-in components 5 can stably be in contact with the internal peripheral surface of the unit casing 4. Accordingly, a wind noise reduction effect is sufficiently provided while preventing the mutual eccentricity of the built-in components and poor acoustic properties. A microphone having a high directivity even in low frequencies can thus be provided.

Figure 4A:
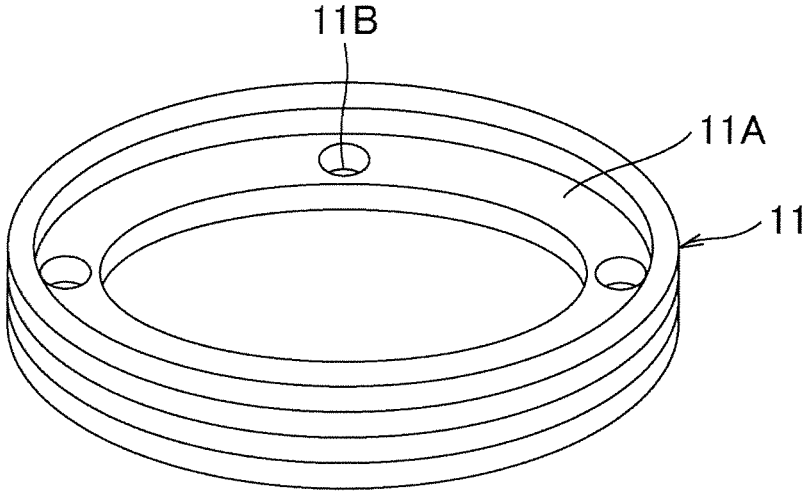
FIG. 4A is a perspective view of an exemplary lock ring in the embodiment.

As shown in FIGS. 1 and 4A, the lock ring 11 has a male thread on the external periphery into which the female thread 9 of the unit casing 4 is to be screwed. The lock ring 11 also has a step 11A provided by circularly trimming the internal peripheral surface in contact with the insulating washer 10. Furthermore, the lock ring 11 has a plurality of holes 11B in the step 11A, the holes 11B extending through the thickness direction (vertical direction in FIG. 1) of the lock ring 11. The step 11A is in communication with the groove B and thus defines the connecting path C. The holes 11B also define a portion of the connecting path C.

Figure 4B:
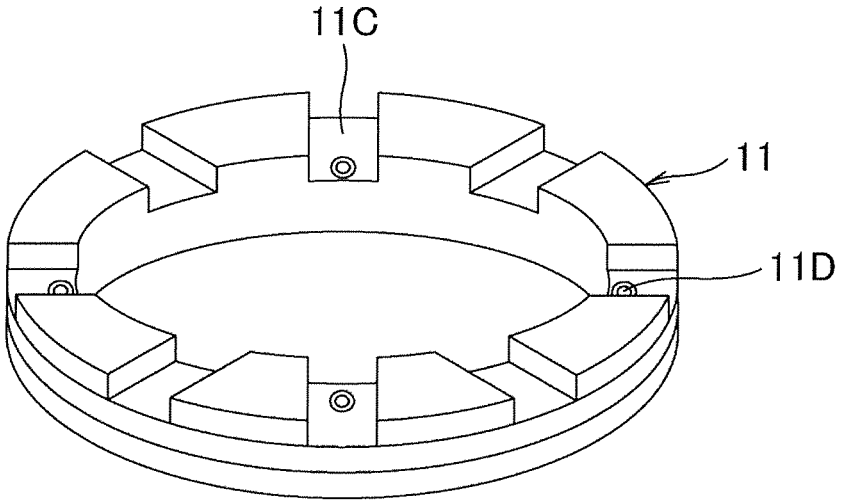
FIG. 4B is a perspective view of another exemplary lock ring applicable to the present invention.

FIG. 4B illustrates another exemplary lock ring 11. In FIG. 4B, the lock ring 11 is provided in its upper surface with recesses 11C formed by trimming the lock ring 11 in the radial direction. The recesses 11C are provided at a plurality of locations at equal distances in the circumferential direction of the lock ring 11. Some of the recesses 11C are provided in the bottom surfaces with cylindrical holes 11D extending through the thickness direction of the lock ring 11. A male thread is provided on the external periphery of the lock ring 11. Screwing the male thread into the female thread 9 of the unit casing 4 fixes the built-in components 5 to the interior of the unit casing 4 and defines a portion of the connecting path C.

Use of the lock ring 11 is optional. The built-in components 5 can be fixed and the connecting path C can be provided without the lock ring 11. For instance, a rear edge of the unit casing 4 may be folded inward such that the folded portion urges the external periphery of the insulating washer 10.

In FIG. 1, the insulating washer 10 has a recess 10A provided in the front surface (upper surface in FIG. 1) in contact with the fixed electrode 12. The recess 10A communicates to the exterior of the unit casing 4 through the rear acoustic terminal 3. The columnar electrode 6 passes through and is fixed in the center of the insulating washer 10. Thereby, audio signals generated by the fixed electrode 12 and the diaphragm 13 are output externally. The fixed electrode 12 covers the recess 10A of the insulating washer 10 and is placed and fixed into a space adjacent to the front surface of the insulating washer 10. The spacer 17 provided between the diaphragm 13 and the fixed electrode 12 allows the diaphragm 13 and the fixed electrode 12 to face each other with a gap having the thickness of the spacer 17 therebetween, thus defining a capacitor between the fixed electrode 12 and the diaphragm 13.

Figure 5:
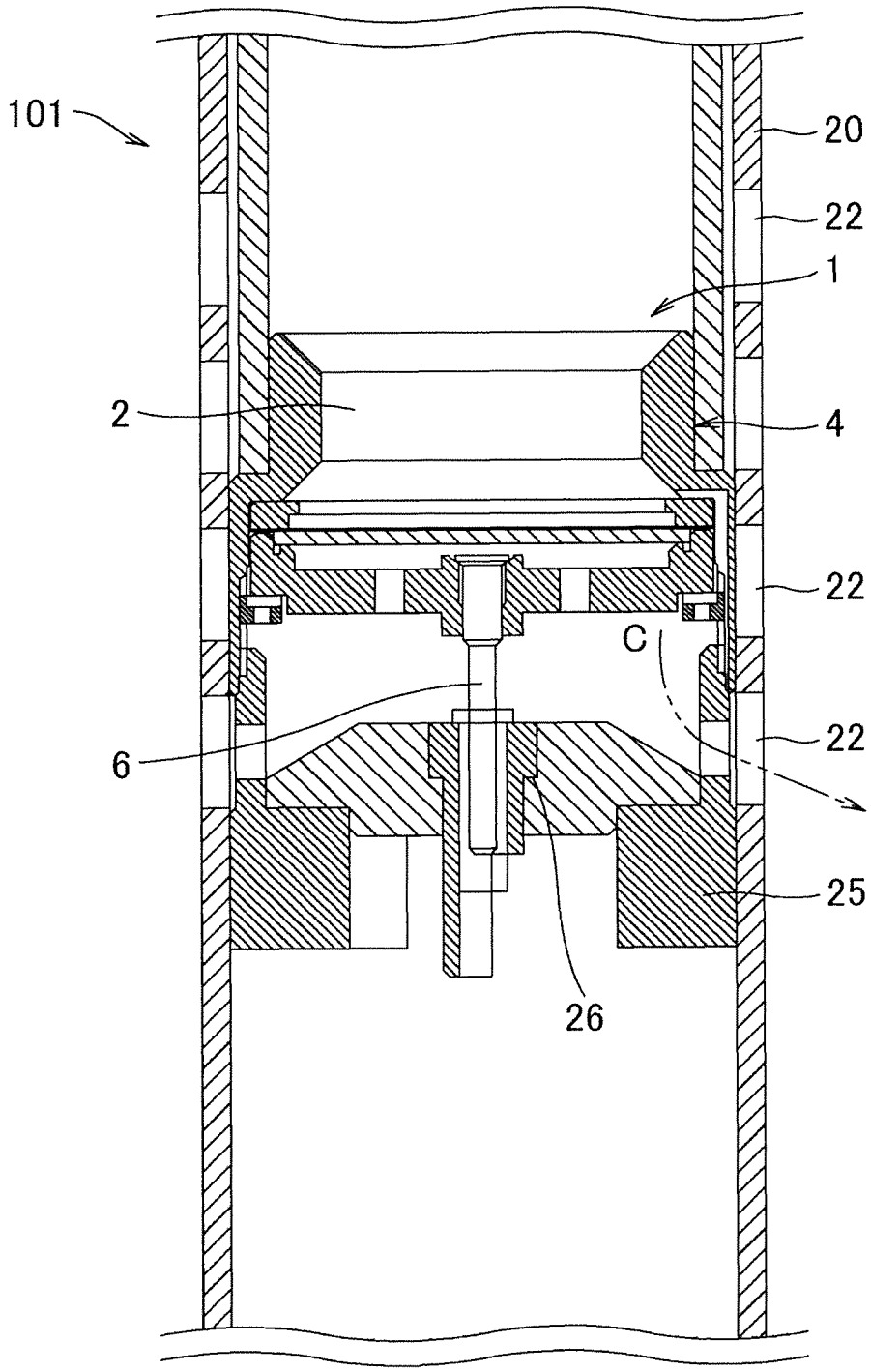
FIG. 5 is a vertical cross-sectional view of a highly directional microphone according to an embodiment of the present invention.

The embodiment of a highly directional microphone having the microphone unit above is explained. In FIG. 5, a highly directional microphone 101 has the microphone unit 1 whose external periphery is fixed to an internal periphery in one end of an acoustic tube 20. A fixing portion 25 is built into the internal periphery of the acoustic tube 20 in the vicinity of the rear end in the length direction. The rear end of the microphone unit 1 is fixed to the fixing portion 25. The microphone unit 1 has the front acoustic terminal 2 fixed to the interior of the acoustic tube 20 toward the front end opening of the acoustic tube 20.

The acoustic tube 20 has a plurality of openings 22 in its peripheral wall. The air released from the connecting path C of the microphone unit 1 is released externally through the openings 22 of the acoustic tube 20, as shown with an an arrow in FIG. 5. An acoustic resistant material (not shown in the drawing) composed of unwoven fabric such as felt or nylon mesh is bonded to the external peripheral surface of the acoustic tube 20 so as to cover the openings 22. An appropriate microphone case (not shown in the drawing) may be fitted to the external peripheral surface of the acoustic tube 20. A portion of the microphone case may be a grip held by a hand in use.

The electrode 6 of the microphone unit 1 is bonded to a connecting portion 26 in the rear end and is connected to a predetermined terminal of a microphone connector (not shown in the drawing) through the connecting portion 26, and thereby the highly directional microphone 101 is provided.

The embodiments of the microphone unit and the highly directional microphone including the microphone unit are explained above. The prevent invention, however, is not limited to the configurations of the embodiments. The present invention may be freely designed and modified without deviating from the technological concept disclosed in the scope of the claims. For instance, the microphone unit may be a dynamic microphone unit in place of a capacitor microphone unit.

What is claimed is:

1. A microphone unit comprising:
- a diaphragm vibrating in response to sound waves;
- a unit casing accommodating the diaphragm;
- a front acoustic terminal connected to the front of the diaphragm;
- a rear acoustic terminal connected to the rear of the diaphragm; and
- at least one connecting path connecting the front acoustic terminal and the rear acoustic terminal,
- wherein the microphone unit converts vibration of the diaphragm into audio signals,
- wherein the unit casing comprises:
  - a small-diameter internal periphery defining the front acoustic terminal;
  - a large-diameter internal periphery accommodating built-in components comprising the diaphragm; and
  - a shoulder provided between the small-diameter internal periphery and the large-diameter internal periphery, the shoulder positioning the built-in components,
- wherein the unit casing has a first groove in an axial direction provided in the large-diameter internal periphery and a second groove in a radial direction provided in the shoulder, the second groove in the radial direction being in communication with the first groove in the axial direction, and
- wherein the first groove in the axial direction and the second groove in the radial direction configure the at least one connecting path.

2. The microphone unit according to claim 1, wherein the at least one connecting path is provided by end-milling.

3. The microphone unit according to claim 1, wherein the at least one connecting path comprises a plurality of connecting paths at equal distances radially in a circumferential direction of the unit casing.

4. The microphone unit according to claim 1, wherein the built-in components are positioned in the unit casing by a lock ring screwed into the unit casing.

5. The microphone unit according to claim 4, wherein the lock ring has a step defining a portion of the at least one connecting path between the front acoustic terminal and the rear acoustic terminal.

6. A highly directional microphone comprising:
- an acoustic tube incorporating a microphone unit comprising:

a diaphragm vibrating in response to sound waves;

a unit casing accommodating the diaphragm;

a front acoustic terminal connected to the front of the diaphragm;

a rear acoustic terminal connected to the rear of the diaphragm; and at least one connecting path connecting the front acoustic terminal and the rear acoustic terminal, wherein the microphone unit converts vibration of the diaphragm into audio signals, wherein the unit casing comprises:

a small-diameter internal periphery defining the front acoustic terminal;

a large-diameter internal periphery accommodating built-in components comprising the diaphragm; and a shoulder provided between the small-diameter internal periphery and the large-diameter internal periphery, the shoulder positioning the built-in components, wherein the unit casing has a first groove in an axial direction provided in the large-diameter internal periphery and a second groove in a radial direction provided in the shoulder, the second groove in the radial direction being in communication with the first groove in the axial direction, and wherein the first groove in the axial direction and the second groove in the radial direction configure the at least one connecting path.

7. The microphone unit according to claim 1, wherein the unit casing comprises a recess connecting the first groove and the second groove to provide the at least one connecting path.

* * * * *